US011746621B2

(12) United States Patent
Greci et al.

(10) Patent No.: US 11,746,621 B2
(45) Date of Patent: Sep. 5, 2023

(54) DOWNHOLE SHUNT TUBE ISOLATION SYSTEM

(71) Applicant: Halliburton Energy Services, Inc., Houston, TX (US)

(72) Inventors: Stephen Michael Greci, Carrollton, TX (US); Paul James, Spring, TX (US); Austin Lee Wright, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 47 days.

(21) Appl. No.: 17/498,680

(22) Filed: Oct. 11, 2021

(65) Prior Publication Data

US 2023/0113839 A1 Apr. 13, 2023

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/14; E21B 2200/06
See application file for complete search history.

(56) References Cited

U.S. PATENT DOCUMENTS 5,375,662 A 12/1994 Echols, III et al.
6,298,916 B1 10/2001 Tibbles et al.
6,302,208 B1 10/2001 Walker et al.
8,453,734 B2 6/2013 Jasek et al.
9,637,999 B2 5/2017 Garcia et al.
2007/0044962 A1 3/2007 Tibbles
2007/0240883 A1* 10/2007 Telfer ..... E21B 34/142 166/381
2011/0100645 A1* 5/2011 Yapici ..... E21B 23/04 166/375
2013/0118729 A1 5/2013 Greci
2013/0312960 A1 11/2013 Jasek et al.
2014/0000913 A1 1/2014 Greci et al.
2014/0116727 A1 5/2014 Cunningham et al.
2014/0144616 A1 5/2014 Greci
(Continued)

OTHER PUBLICATIONS

International Search Report and Written Opinion for Application No. PCT/US2021/057665, dated Jun. 30, 2022.

*Primary Examiner* — Dany E Akakpo
(74) *Attorney, Agent, or Firm* — Scott Richardson; C. Tumey Law Group PLLC

(57) ABSTRACT

A downhole shunt tube isolation system includes an isolation sleeve housing defining an isolation sleeve chamber and an isolation sleeve moveable within the isolation sleeve chamber between an open position and a closed position. The isolation sleeve has a slurry pathway that fluidically couples a first slurry tube segment to a second slurry tube segment with the isolation sleeve in the open position and fluidically decouples the first slurry tube segment from the second slurry tube segment in the closed position. The downhole shunt tube isolation system further includes a fluid channel in communication with the isolation sleeve chamber. The channel is initially closed to hydraulically lock the isolation sleeve in the open position. Additionally, the downhole shunt tube isolation system includes an actuation mechanism configured to open the fluid channel to hydraulically unlock the isolation sleeve and a biasing member to bias the isolation sleeve to the closed position.

21 Claims, 4 Drawing Sheets

(56) References Cited

U.S. PATENT DOCUMENTS

| | | | |
|---|---|---|---|
| 2014/0262324 | A1 | 9/2014 | Greci et al. |
| 2014/0332211 | A1 | 11/2014 | Cunningham et al. |
| 2015/0000897 | A1 | 1/2015 | Lopez et al. |
| 2015/0013970 | A1 | 1/2015 | Jaaskelainen et al. |
| 2015/0204168 | A1 | 7/2015 | Greci |
| 2015/0218916 | A1 | 8/2015 | Richards et al. |
| 2016/0160615 | A1 | 6/2016 | Greci et al. |
| 2016/0215595 | A1 | 7/2016 | Lopez et al. |
| 2016/0215598 | A1 | 7/2016 | Lopez et al. |
| 2016/0251908 | A1 | 9/2016 | Veit et al. |
| 2016/0265318 | A1 | 9/2016 | Greci et al. |
| 2017/0016310 | A1 | 1/2017 | Greci et al. |
| 2018/0080318 | A1 | 3/2018 | Schexnaider et al. |
| 2018/0179863 | A1 | 6/2018 | Least et al. |
| 2019/0040714 | A1 | 2/2019 | Fripp et al. |
| 2019/0063182 | A1 | 2/2019 | Fripp et al. |
| 2019/0120026 | A1 | 4/2019 | Fripp et al. |
| 2019/0128090 | A1 | 5/2019 | Gano et al. |
| 2019/0309605 | A1 | 10/2019 | Greci et al. |
| 2020/0131891 | A1 | 4/2020 | Least et al. |
| 2020/0263520 | A1 | 8/2020 | Frosell et al. |
| 2021/0087908 | A1 | 3/2021 | Novelen et al. |
| 2021/0115758 | A1 | 4/2021 | Greci et al. |
| 2021/0123310 | A1 | 4/2021 | Fripp et al. |
| 2021/0140255 | A1 | 5/2021 | Greci et al. |
| 2021/0140280 | A1 | 5/2021 | Malone et al. |
| 2021/0140281 | A1 | 5/2021 | Greci et al. |
| 2021/0140283 | A1 | 5/2021 | El Mallawany et al. |

* cited by examiner

DOWNHOLE SHUNT TUBE ISOLATION SYSTEM

BACKGROUND

In some well completions, a gravel packing operation may be employed to provide filtration to keep sand in unstable production zones from entering a well stream. The gravel packing operation may include pumping a gravel slurry into a well having a plurality of production zones. Packers may be set in the well to separate the production zones. If the packers are set prior to placing the gravel slurry, then the packers may include bypass holes such that the gravel slurry may pass through the bypass holes via corresponding shunt tubes extending through the bypass holes. Unfortunately, having the bypass holes in the packers may fluidly connect each of the production zones such that the production zones are not isolated. However, having isolated production zones may be advantageous to prevent fluids (e.g., natural gas or water) from flowing into adjacent production zones in the event of a breakthrough or similar event.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for actuating a downhole shunt tube isolation system from an open position to a closed position. At least one shunt tube may extend through bypasses in packer assemblies to fluidly connect adjacent production zones such that gravel slurry may be pumped into the well through the packer assemblies and to each production zone. However, fluidly connecting the production zone may leave all the production zones vulnerable to a breakthrough in a single production zone. Thus, at least for the reason of isolating potential breakthroughs to a single production zone, the downhole shunt tube isolation system may actuate from an open position to a closed position. Moving to the close position decouples a first segment of the shunt tube from a second segment of the shunt tube at the downhole shunt tube isolation system to isolate the adjacent production zones. In some embodiments, multiple downhole shunt tube isolation systems may be actuated to isolate one or more production zones in the well.

Figure 1:
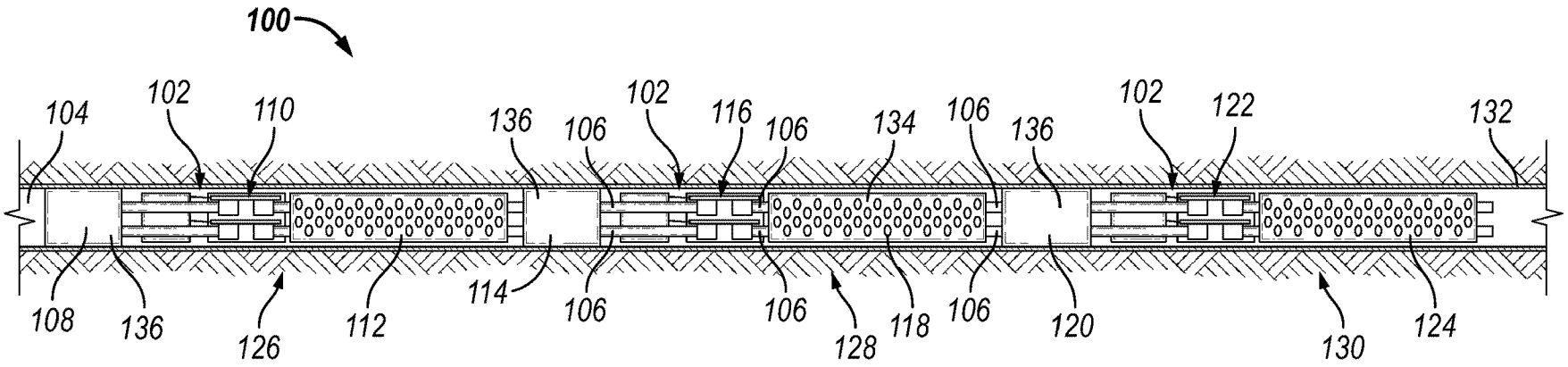
FIG. 1 illustrates a side elevation, partial cross-section view of an operational environment for a completion system, in accordance with some embodiments of the present disclosure.

FIG. 1 illustrates a side elevation, partial cross-section view of an operational environment for a completion system 100, in accordance with some embodiments of the present disclosure. Downhole shunt tube isolation systems 102 may be installed in the well 104 during completion operations. In the illustrated embodiment, shunt tubes 106 extend from a first packer 108, through a first downhole shunt tube isolation system 110, through a first screen joint 112, through a second packer 114, through a second downhole shunt tube isolation system 116, through a second screen joint 118, through a third packer 120, through a third downhole shunt tube isolation system 122, and to a third screen joint 124. As such, the shunt tubes 106 fluidly connect each production zone (e.g., a first production zone 126, a second production zone 128, and a third production zone 130) such that gravel slurry may be placed in each production zone to provide filtration. The production zones 126, 128, 130 are separated via the packers 108, 114, 120, which expand to form seals against an inner surface of a casing 132. As the gravel slurry flows through the shunt tubes 106, a portion of the gravel slurry may be diverted into each the production zone 126, 128, 130 via the respective screen joints 112, 118, 124 to gravel pack the respective production zones 126, 128, 130.

In the event of a breakthrough, fluids (e.g., natural gas or water) may flow into the shunt tubes 106 at a screen joint 134. Thus, to isolate each production zone, at least one downhole shunt tube isolation system 102 may be installed between each screen joint 134. For example, to isolate the second production zone 128 the second downhole shunt tube isolation system 116 and the third downhole shunt tube isolation system 122 may be actuated from respective open to closed positions. As the second downhole shunt tube isolation system 116 is disposed between the first screen joint 112 and the second screen joint 118, closing the second downhole shunt tube isolation system 116 isolates the second production zone 128 from the first production zone 126. Further, as the third downhole shunt tube isolation system 122 is disposed between the second screen joint 118 and the third screen joint 124, closing the third downhole shunt tube isolation system 122 isolates the second production zone 128 from the third production zone 130. Thus, closing the second downhole shunt tube isolation system 116 and third downhole shunt tube isolation system 122 may fluidly isolate the second screen joint 118 from the adjacent screen joints 112, 124 to contain the breakthrough to the second production zone 128.

In some embodiments, multiple screen joints 134 may be disposed between each packer 136 However, the completion system 100 may still only include a single shunt tube isolation system 102 between each adjacent packer 136 to isolate the respective production zones 126, 128, 130. For example, the second shunt tube isolation system 116 may be disposed between the second packer 114 and the second screen joint 118, and additional screen joints (not shown) may be disposed between the second screen joint 118 and the third packer 120. The third shunt tube isolation system 122 may be disposed between the third packer 120 and the third screen joint 124. Although the completion system 100 includes multiple screen joints 134 between the second packer 114 and the third packer 120, closing the second shunt tube isolation system 116 and the third shunt tube isolation system 122 still isolate the second production zone 128 from the first production zone 126 and the third production zone 130, respectively.

Figure 2:
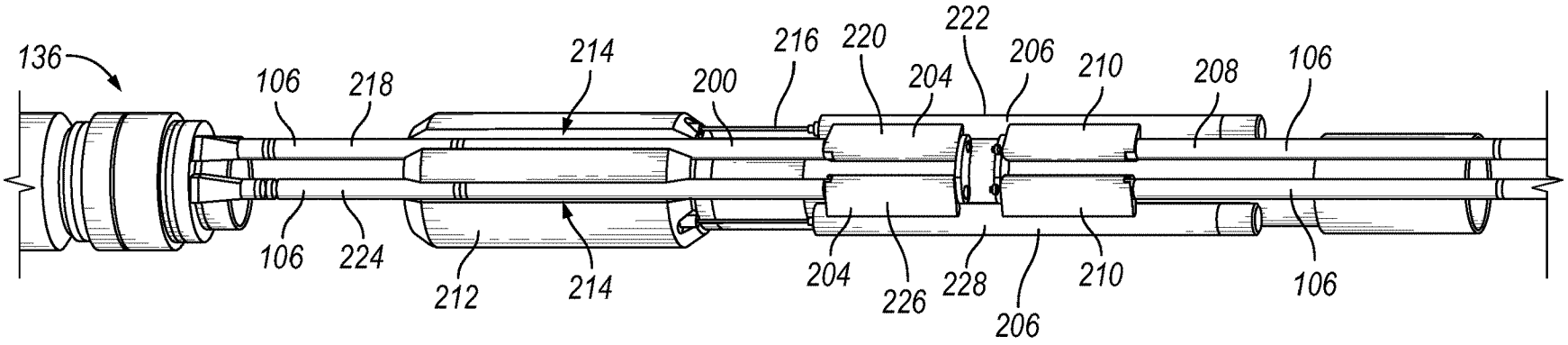
FIG. 2 illustrates a perspective view of a shunt tube isolation system of the completion system, in accordance with some embodiments of the present disclosure.

FIG. 2 illustrates a perspective view of a shunt tube isolation system 102 of the completion system 100, in accordance with some embodiments of the present disclosure. In the illustrated embodiment, the downhole shunt tube isolation system 102 includes multiple shunt tubes 106 each having a first tube segment 200 and a second tube segment 208. In the illustrate embodiment, the first tube segment 200 of a first shunt tube 218 extends from a packer 136 to an isolation inlet module 204 (e.g., a first isolation inlet module 220). However, in some embodiment, the first tube segment 200 may extend from the packer 136 directly to an isolation sleeve housing 206 (e.g., a first isolation sleeve housing 222). Similarly, the first tube segment 200 of a second shunt tube 224 extends from the packer 136 to a second isolation inlet module 226. However, in some embodiments, the first tube segment may extend from the packer directly to a second isolation sleeve housing 228. Moreover, multiple shunt tubes 106 may extend from the packer 136 to a single isolation inlet module 204 or directly a single insolation sleeve housing 206. For example, the first tube segments 200 of both the first shunt tube 218 and the second shunt tube 224 may extend from the packer 136 to the first isolation inlet module 220 or directly to the first isolation inlet housing 222.

The second tube segment 208 extends from an isolation outlet module 210 toward a respective screen joint (shown in FIG. 1). Alternatively, the second tube segment 208 may extend directly from the isolation sleeve housing 206 to the respective screen joint. In an open position, the isolation sleeve housing 206 couples the first tube segment 200 to the second tube segment 208. However, actuating the shunt tube isolation system 102 to the closed position includes decoupling the first tube segment 200 from the second tube segment 208 via the isolation sleeve housing 206.

Moreover, the shunt tube isolation system 102 may include a shifting sleeve housing 212. In the illustrated embodiment, the shunt tubes 106 are disposed within slots 214 formed in the shifting sleeve housing 212. Alternatively, the shunt tubes 106 may extend around, through, or within the shifting sleeve housing 212. In the illustrated embodiment, the shifting sleeve housing 212 is in hydraulic communication with the isolation sleeve housing 206 via a hydraulic coupling 216. The hydraulic coupling 216 may include any suitable fluid line for conveying hydraulic fluids (e.g., oil, butanol, esters, etc.) As set forth in detail below, hydraulic communication between the shifting sleeve housing 212 and the isolation sleeve housing 206 may actuate the shunt tube isolation system 102 from the open position to the closed position. In some embodiments, the shifting sleeve housing 212 may be secured directly to the isolation sleeve housing 206 to fluidly couple the shifting sleeve housing 212 with the isolation sleeve housing 206. Further, in some embodiments, the shifting sleeve housing 212 and the isolation sleeve housing 206 may be a single housing.

Figure 3:
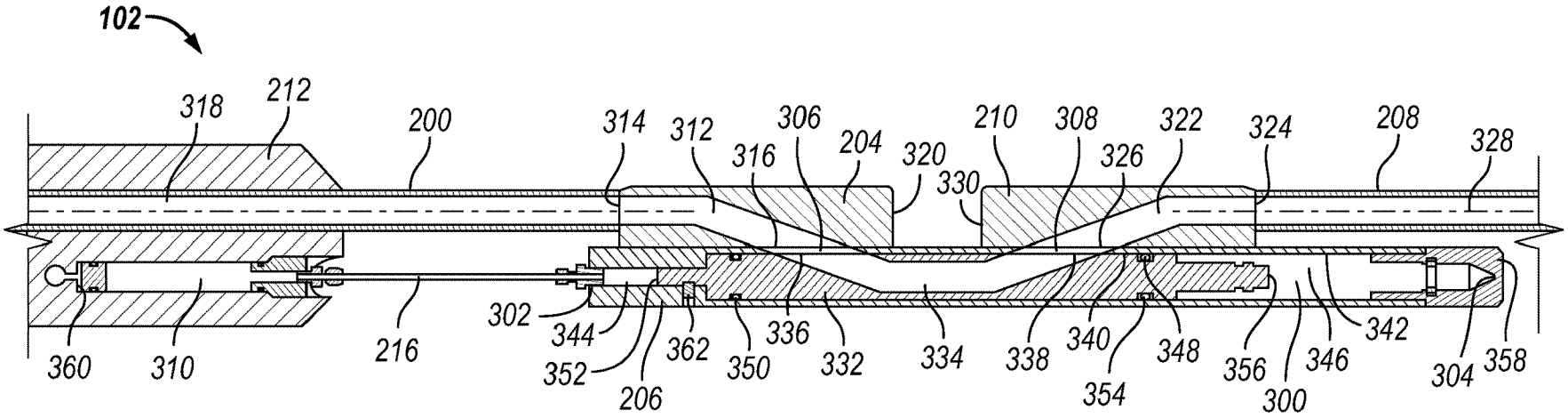
FIG. 3 illustrates a cross-sectional view of the shunt tube isolation system in an open position, in accordance with some embodiments of the present disclosure.

FIG. 3 illustrates a cross-sectional view of the shunt tube isolation system 102 in an open position, in accordance with some embodiments of the present disclosure. The downhole shunt tube isolation system 102 includes the isolation sleeve housing 206. The isolation sleeve housing 206 defines an isolation sleeve chamber 300 disposed within the isolation sleeve housing 206. The isolation sleeve chamber 300 includes an open axial end 302, a sealed axial end 304 disposed opposite the open axial end 302, a radial inlet 306, and a radial outlet 308. The open axial end 302 may be in fluid communication with the shifting sleeve housing 212 via the hydraulic coupling 216. In particular, the open axial end 302 may be in fluid communication with a piston chamber 310 defined in the shifting sleeve housing 212. Further, the radial inlet 306 may be in fluid communication with the first tube segment 200, and the radial outlet 308 may be in fluid communication with the second tube segment 208. In some embodiments, the first tube segment 200 and the second tube segment 208 may be directly coupled to the radial inlet 306 and the radial outlet 308, respectively. However, in the illustrated embodiment, the first tube segment 200 and the second tube segment 208 are coupled to the isolation sleeve housing 206 via the isolation inlet module 204 and the isolation outlet module 210, respectively.

The isolation inlet module 204 includes an inlet module pathway 312 extending through the isolation inlet module 204. In the illustrated embodiment, the inlet module pathway 312 extends from a first axial opening 314 in the isolation inlet module 204 to a first radial opening 316 in the isolation inlet module 204. In the illustrated example, the isolation inlet module and the isolation sleeve housing are not axially aligned. As such, at least a portion of the inlet module pathway 312 may be angularly offset from a central axis 318 of the first tube segment 200. However, the inlet module pathway 312 may be defined within the isolation inlet module 204 to minimize a maximum degree of the angular offset, along the inlet module pathway 312, from the central axis 318. Indeed, in some embodiments, the first radial opening 316 may be positioned proximate an axial end 320 of the isolation inlet module 204 disposed opposite the first axial opening 314. Increasing an axial distance between the first axial opening 314 and the first radial opening 316 may decrease the maximum degree of the angular offset. In some embodiments, the maximum degree of the angular offset along the inlet module pathway 312 may be between ten and forty-five degrees. Alternatively, the maximum degree of the angular offset along the inlet module pathway 312 may be between twenty and thirty degrees.

Similarly, the isolation outlet module 210 includes an outlet module pathway 322 extending through the isolation outlet module 210. In the illustrated embodiment, the outlet module pathway 322 extends from a second axial opening 324 in the isolation outlet module 210 to a second radial opening 326 in the isolation outlet module 210. As such, the outlet module pathway 322 may be at least partially angularly offset from a central axis 328 of the second tube segment 208. However, the outlet module pathway 322 may be defined within the isolation outlet module 210 to minimize a maximum degree of the angular offset, along the outlet module pathway 322, from the central axis 328. Indeed, in some embodiments, the second radial opening 326 may be positioned proximate a corresponding axial end 330 of the isolation outlet module 210 disposed opposite the second axial opening 324. Increasing an axial distance between the second axial opening 324 and the second radial opening 326 may decrease the maximum degree of the angular offset. In some embodiments, the maximum degree of the angular offset along the outlet module pathway 322 may be between ten and forty-five degrees. Alternatively, the maximum degree of the angular offset along the outlet module pathway 322 may be between twenty and thirty degrees.

Moreover, the first tube segment 200 may be coupled to the first axial opening 314 of the isolation inlet module 204, and the first radial opening 316 may be coupled to the radial inlet 306 of the isolation sleeve housing 206 to fluidly connect the first tube segment 200 to the isolation sleeve housing 206 via the inlet module pathway 312. Further, the second radial opening 326 of the isolation outlet module 210 may be coupled to the radial outlet 308 of the isolation sleeve 332, and the second axial opening 324 may be coupled to the second tube segment 208 to fluidly connect the isolation sleeve housing 206 to the second tube segment 208 via the outlet module pathway 322.

Figure 6:
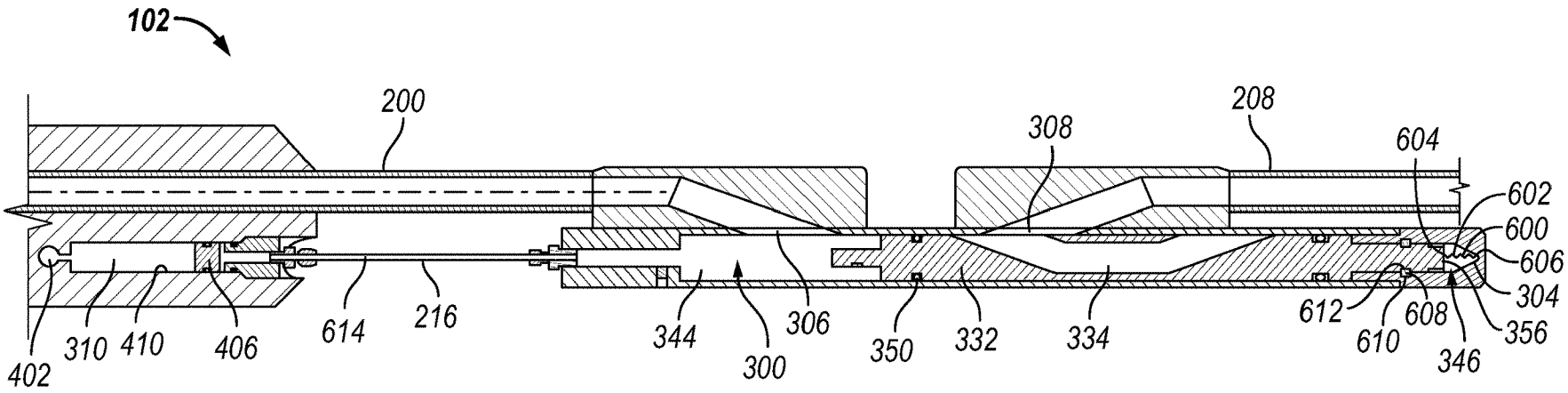
FIG. 6 illustrates another cross-sectional view of the shunt tube isolation system in the closed position, in accordance with some embodiments of the present disclosure.

The shunt tube isolation system 102 further includes an isolation sleeve 332 moveable within the isolation sleeve chamber 300 between an open position and a closed position (shown in FIG. 6). In the illustrated embodiment, the isolation sleeve 332 is in the open position. The isolation sleeve 332 defines a slurry pathway 334 extending through at least a portion of the isolation sleeve 332. The slurry pathway 334 includes a radial isolation sleeve inlet 336 and a radial isolation sleeve outlet 338 that each pass through a radially outer surface 340 of the isolation sleeve 332. The isolation sleeve inlet 336 and the isolation sleeve outlet 338 are angularly aligned about the circumference of the isolation sleeve 332. However, in some embodiments, the isolation sleeve inlet 336 and the isolation sleeve outlet 338 may angularly offset based on respective angular positions of the isolation inlet module 204 and the isolation outlet module 210 with respect to the isolation sleeve housing 206. Moreover, as illustrated, in the open position, the radial isolation sleeve inlet 336 is aligned with the radial inlet 306 of the isolation sleeve housing 206 such that the slurry pathway 334 is in fluid communication with the first tube segment 200 either directly or via the isolation inlet module 204. Further, in the open position, the radial isolation sleeve outlet 338 is aligned with the radial outlet 308 of the isolation sleeve housing 206 such that the slurry pathway 334 is in fluid communication with the second tube segment 208 either directly or via the isolation outlet module 210. As such, the isolation sleeve 332 may fluidly couple the first tube segment 200 to the second tube segment 208 in the open position.

In the illustrated embodiment, the radially outer surface 340 of the isolation sleeve 332 is sealed against a radially inner surface 342 of the isolation sleeve chamber 300 such that the isolation sleeve chamber 300 is partitioned into an open portion 344 and a sealed portion 346 by the isolation sleeve 332. The isolation sleeve 332 may include at least one annular seal 348 disposed between the radially outer surface 340 of the isolation sleeve 332 and the radially inner surface 342 of the isolation sleeve chamber 300 to form a seal. In the illustrated embodiment, the isolation sleeve 332 includes a first annular seal 350 disposed about the isolation sleeve 332 between an open axial side 352 of the isolation sleeve 332 and the radial isolation sleeve inlet 336 such that the first annular seal 350 may seal the open portion 344 of the isolation sleeve chamber 300 from the radial inlet 306. Further, the isolation sleeve 332 includes a second annular seal 354 disposed about the isolation sleeve 332 between a sealed axial side 356 of the isolation sleeve 332 and the radial isolation sleeve outlet 338 such that the second annular seal 354 may seal the sealed portion 346 of the isolation sleeve chamber 300 from the radial outlet 308, the radial inlet 306, and the open portion 344 of the isolation sleeve chamber 300.

The sealed portion 346 of the isolation sleeve chamber 300 is defined between the sealed axial side 356 of the isolation sleeve 332, the radially inner surface 342 of the isolation sleeve chamber 300, and the sealed axial end 304 of the isolation sleeve chamber 300. The second annular seal 354 may provide an air-tight seal for the sealed portion 346. Indeed, in the open position, the sealed portion 346 of the isolation sleeve chamber 300 is filled with air comprising a pressure between 0.0-1.0 atmosphere (atm). During assembly of the isolation sleeve housing 206, the isolation sleeve 332 may be inserted into the isolation sleeve chamber 300 via the sealed axial end 304. After insertion of the isolation sleeve 332, a receiver cap 358 may be secured to the sealed axial end 304 of the isolation sleeve chamber 300 with the isolation sleeve housing 206 at or above the surface. Further, the secured receiver cap 358 may form an airtight seal at the sealed axial end 304 of the isolation sleeve chamber 300 such that the air at or above the surface, having the pressure between 0.0-1.0 atmosphere (atm), is sealed within the sealed portion 346 of the isolation sleeve chamber 300.

As set forth in detail below, the sealed portion 346 may provide a vacuum force, via a pressure differential, on the isolation sleeve 332 that biases the isolation sleeve 332 toward the sealed axial end 304 of the isolation sleeve chamber 300. However, in the open position, the open portion 344 of the isolation sleeve chamber 300 and the piston chamber 310 of the shifting sleeve housing 212 are sealed at both the open axial side 352 of the isolation sleeve 332 and at a channel 402 end 360 of the piston chamber 310. As the open portion 344 and the piston chamber 310 may also be sealed at or above the surface, the isolation sleeve 332 may be maintained in the open position so long as the open portion 344 and the piston chamber 310 are sealed.

Moreover, the shunt tube isolation system 102 may further include a retention feature 362 configured to restrain rotational and/or axial movement of the isolation sleeve 332 such that the isolation sleeve 332 may be maintained in the open position. The retention feature 362 may include a shear pin, an adhesive, or other suitable feature for temporarily affixing the isolation sleeve 332 to the isolation sleeve housing 206.

Figure 4:
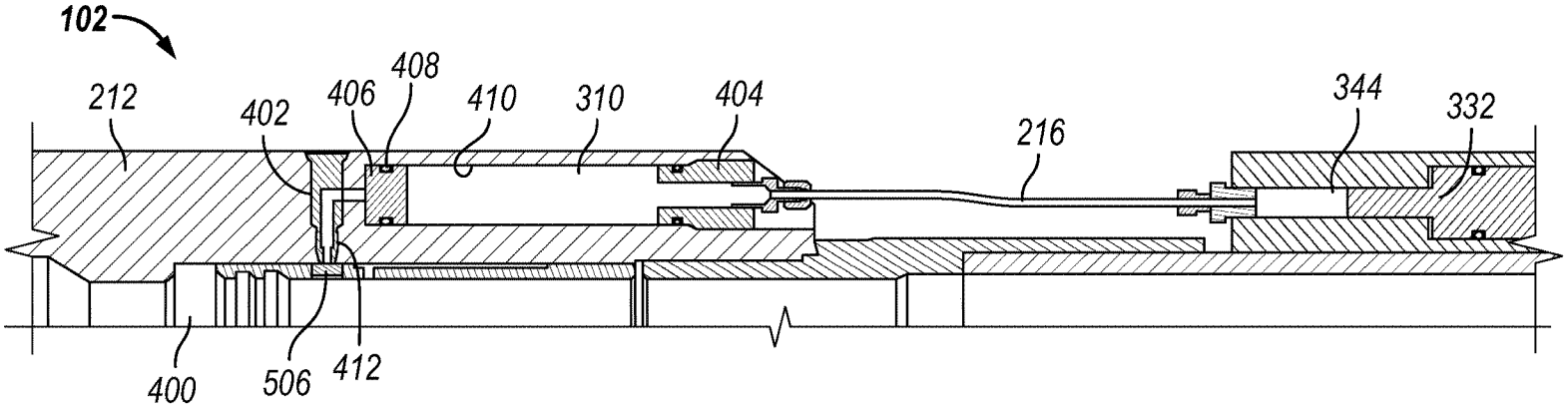
FIG. 4 illustrates another cross-sectional view of the shunt tube isolation system in the open position, in accordance with some embodiments of the present disclosure.

FIG. 4 illustrates another cross-sectional view of the shunt tube isolation system 102 in the open position, in accordance with some embodiments of the present disclosure. In the illustrated embodiment, the shunt tube isolation system 102 includes the shifting sleeve housing 212. In some embodiments, the shunt tube isolation system 102 may instead include features of the shifting sleeve housing 212 in the isolation sleeve housing 206. Moreover, in the illustrated embodiment, the shifting sleeve housing 212 defines the piston chamber 310, a central bore 400 extending axially through the shifting sleeve housing 212, and a channel 402 extending from the central bore 400 to the piston chamber 310. As set forth above, the piston chamber 310 is in fluid communication with the open portion 344 of the isolation sleeve chamber 300 via the hydraulic coupling 216. In some embodiments, the hydraulic coupling 216 is secured directly to the shifting sleeve housing 212. However, in the illustrated embodiment, the hydraulic coupling 216 is secured to a cap seal 404, and the cap seal 404 is secured to the shifting sleeve housing 212.

The shunt tube isolation system 102 may further include a piston 406 disposed within the piston chamber 310. In the open position, the piston 406 may be disposed in the piston chamber 310 in a position proximate the channel 402. The piston 406 may include an annular piston seal 408 configured to seal the piston 406 against a radially inner surface 410 of the piston chamber 310. Further, the piston 406 may be configured to slide axially along the piston chamber 310, in a direction away from the channel 402, as the shunt tube isolation system 102 transitions from the open position to the closed position (shown in FIG. 5). In the illustrated embodiment, the shunt tube isolation system 102 is in the open position.

Moreover, in the open position, the piston chamber 310 and the open portion 344 of the isolation sleeve chamber 300 may be filled with a hydraulic fluid (e.g., oil). In particular, the hydraulic fluid is configured to fill a space in the piston chamber 310, the hydraulic coupling 216, and the open portion 344, between the piston 406 and the isolation sleeve 332. As the space between the isolation sleeve 332 and the piston 406 is filled with hydraulic oil, the piston 406 is in hydraulic communication with the isolation sleeve 332 and actuating the piston 406 in a direction toward the isolation sleeve 332 may apply a driving force on the isolation sleeve 332. In some embodiments, the shunt tube isolation system 102 is configured to operate without a piston 406 such that the hydraulic fluid fills the entire piston chamber 310.

As set forth above, the shifting sleeve housing 212 defines the channel 402 extending from the central bore 400 to the piston chamber 310. The central bore 400 is exposed to the wellbore environment such that fluid in the central bore 400 has a high pressure. As such, the central bore 400 may be a high-pressure fluid source for the shunt tube isolation system 102. In the open position, the hydraulic oil, in the piston chamber 310 and open portion 344, has a low pressure (e.g., surface pressure), which is lower than the high pressure of the fluid in the central bore 400. Although the high pressure of the fluid in the central bore 400 would naturally flow into the low pressured piston chamber 310, the shunt tube isolation sleeve 332 system includes a plug 412 configured to seal the central bore 400 from the piston chamber 310. Indeed, in the open position of the shunt tube isolation system 102, the plug 412 maintains the low pressure of the hydraulic oil in the piston chamber 310 and open portion 344, such that low pressure of the hydraulic oil in the open portion 344 is substantially similar to the pressure of the air in the sealed portion 346 of the isolation sleeve chamber 300. In the open position, a pressure differential across the isolation sleeve 332 may be insufficient to move the isolation sleeve 332. Thus, the plug 412 is configured to hydraulically lock the isolation sleeve 332 in the open position.

Figure 5:
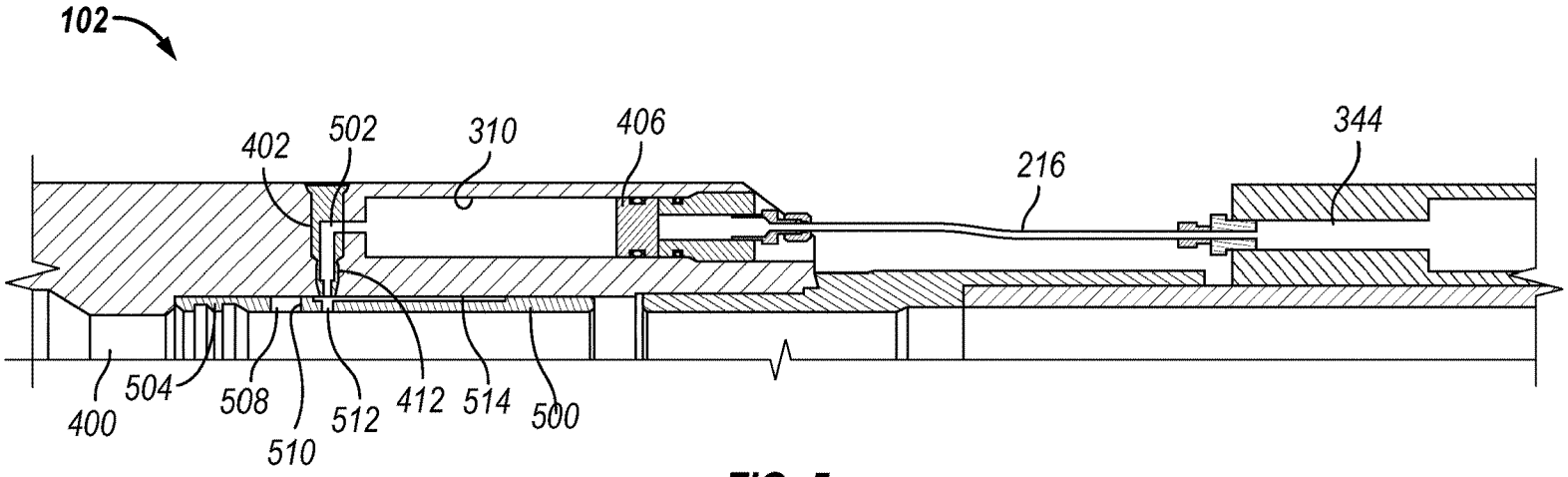
FIG. 5 illustrates a cross-sectional view of the shunt tube isolation system in a closed position, in accordance with some embodiments of the present disclosure.

FIG. 5 illustrates a cross-sectional view of the shunt tube isolation system 102 in a closed position, in accordance with some embodiments of the present disclosure. As set forth above, the plug 412 hydraulically locks the isolation sleeve 332 in the open position (shown in FIG. 3) by sealing the central bore 400 from the piston chamber 310. That is, the plug 412 seals the channel 402 that fluidly connects the central bore 400 to the piston chamber 310. In some embodiments, the shunt tube isolation system 102 may include alternative features (e.g., a valve, a dissolvable material, etc.) to seal the channel 402. Moreover, the shunt tube isolation system 102 includes an actuation mechanism 500 configured to open the channel 402; thereby, hydraulically unlocking the isolation sleeve 332. Opening the channel 402 may result in a pressure differential across the isolation sleeve 332 that drives the isolation sleeve 332 to the closed position (shown in FIG. 6).

The shunt tube isolation system 102 may include an actuation mechanism 500 to open the channel 402. In some embodiments, the actuation mechanism 500 may include a hydraulic device configured to displace a portion of the plug 412 to open a fluid path 502 through the plug 412 such that fluid from the central bore 400 may pass through the channel 402 to the piston chamber 310. In the illustrated embodiment, the actuation mechanism 500 includes a mechanical device configured to displace a portion of the plug 412 to open a fluid path 502 through the plug 412. Specifically, the actuation mechanism 500 includes an inner sleeve 504 disposed within the central bore 400 of the shifting sleeve housing 212. The inner sleeve 504 is configured to slide along the shifting sleeve housing 212 to displace an inner tip portion 506 (shown in FIG. 4) of the plug 412 and open the fluid path 502 through the plug 412 to the piston chamber 310. The inner tip portion 506 may extend out of the channel 402 toward the central bore 400. In the illustrated embodiment, the inner sleeve 504 includes a recess 508. In the open position, the inner tip portion 506 extends into the recess 508 shown in FIG. 4). Sliding the inner sleeve 504 causes a sidewall 510 of the recess 508 to contact the inner tip portion 506. As the inner sleeve 504 continues to slide, the sidewall 510 of the recess 508 displaces the inner tip portion 506 exposing the fluid path 502 through the plug 412. The inner sleeve 504 may further include a borehole 512 extending radially through the inner sleeve 504. As illustrated, the inner sleeve 504 slides along the central bore 400 to an actuated position. In some embodiments, the inner sleeve 504 may be configured to lock in the actuated position to restrain the inner sleeve 504 from further movement. Moreover, in the actuated position, the borehole 512 extending through the inner sleeve 504 may align with the fluid path 502 through the plug 412 to fluidly connect the central bore 400 to the fluid path 502 through the plug 412. However, in some embodiments, the borehole 512 may only be partially aligned with the fluid path 502. Alternatively, the inner sleeve 504 may not be sealed against an inner surface 514 of the central bore 400 such that displacing the inner tip portion 506 may expose the fluid path 502 to fluid in the central bore 400 through a space between the inner sleeve 504 and the inner surface 514 of the central bore 400. Further, in some embodiments, the fluid path 502 may be exposed to the fluid in the central bore 400 via a combination of a misaligned borehole 512 and the space between the inner sleeve 504 and the inner surface 514 of the central bore 400.

FIG. 6 illustrates another cross-sectional view of the shunt tube isolation system 102 in the closed position, in accordance with some embodiments of the present disclosure. As illustrated, with the isolation sleeve 332 in the closed position, the slurry pathway 334 is misaligned with respect to the radial inlet 306 and the radial outlet 308, which blocks flow of the gravel slurry from the first tube segment 200 to the second tube segment 208. Thus, moving the isolation sleeve 332 to the closed position fluidically decouples the first tube segment 200 from the second tube segment 208 in the closed position.

Opening the channel 402, via the actuation mechanism 500 (shown in FIG. 5), may cause a pressure differential across the isolation sleeve 332 to move the isolation sleeve 332 to the closed position. The sealed portion 346 of the isolation sleeve chamber 300 is filled with air, which is compressible, having a pressure at or around surface pressure. Thus, the pressure differential between the low-pressure air in the sealed portion 346 and the high-pressure fluid from the central bore 400 (shown in FIG. 5) may compress the air in the sealed portion 346 and create a vacuum effect in the sealed portion 346 that drives the isolation sleeve 332, in a direction toward the sealed axial end 304 of the isolation sleeve chamber 300, to the closed position. In some embodiments, the shunt tube isolation system 102 may additionally or alternatively include a biasing member 600 to drive the isolation sleeve 332 toward the closed position. The biasing member 600 may include a tension spring 602 and/or any suitable device for driving the isolation sleeve 332 toward the closed position. For example, the biasing member 600 may include a tension spring 602 having a first end 604 attached to the sealed axial side 356 of the isolation sleeve 332 and a second end 606 attached to the sealed axial end 304 of the isolation sleeve 332. The tension spring 602 may pull the isolation sleeve 332 and the seal axial end 304 toward each other; thereby, driving the isolation sleeve 332 toward the closed position. As illustrated, the sealed axial side 356 of the isolation sleeve 332 may be disposed proximate the sealed axial end 304 of the isolation sleeve chamber 300 in the closed position.

Further, the shunt tube isolation system 102 may include a snap ring 608 configured to secure the isolation sleeve 332 in the closed position. For example, the snap ring 608 may be positioned in a radial recess 610 proximate the sealed axial end 304 of the isolation sleeve chamber 300 housing. The isolation sleeve 332 may include a corresponding recess 612 configured to receive the snap ring 608. In the closed position, the isolation sleeve 332 may be positioned to align the radial recess 610 with the corresponding recess 612 such that the snap ring 608 expands into the corresponding recess 508 and secures the isolation sleeve 332 in the closed position. Alternatively, the shunt tube isolation system 102 may use any suitable securing mechanism to hold the isolation sleeve 332 in the close position.

As set forth above, opening the channel 402 may cause the pressure differential across the isolation sleeve 332 to move the isolation sleeve 332 to the closed position. As the space between the piston 406 and the isolation sleeve 332 is filled with hydraulic oil, the piston 406 may initially remain a substantially constant distance from the isolation sleeve 332 while the space is sealed from the radial inlet 306. Thus, as the isolation sleeve 332 moves from the open position (see FIG. 3) to the closed position, the piston 406 is configured to slide along the piston chamber 310 in a direction away from the channel 402 or in a direction toward the isolation sleeve 332. A speed of travel of the piston 406 may be based at least in part on a magnitude of the pressure differential. Additionally, the speed of travel of the piston 406 may be based on a size of a passageway 614 through the hydraulic coupling 216. The hydraulic coupling 216 may include the passageway 614 having a diameter that is smaller than the respective diameters of the piston chamber 310 and the open portion 344 of the isolation sleeve chamber 300 such that the passageway 614 chokes flow of the hydraulic oil from the piston chamber 310 to the open portion 344 of the isolation sleeve chamber 300 as the piston 406 moves along the piston chamber 310. Choking the flow of the hydraulic fluid through the passageway 614 may slow movement or actuation of the isolation sleeve 332 from the open position to the closed position to reduce strain on components of the shunt tube isolation system 102. In some embodiments, the passageway 614 includes a relative diameter between 0.5-0.01 of the diameter of the piston chamber 310.

Moreover, as the isolation sleeve 332 slides toward the closed position, the first annular seal 350 may slide past the radial inlet 336 and break the seal between the open portion 344 of the isolation sleeve chamber 300 and the radial inlet 336. Gravel slurry passing through the first tube segment 200 may enter the open portion 344 of the isolation sleeve chamber 300 via the radial inlet 336. Although having gravel slurry in the open portion 344 of the isolation sleeve chamber 300 is permissible, it may be undesirable for the gravel slurry to enter the central bore 400. However, the piston 406 is sealed against the radially inner surface 410 of the piston chamber 310 to block gravel slurry from passing through the piston chamber 310 to the central bore 400.

Figure 7:
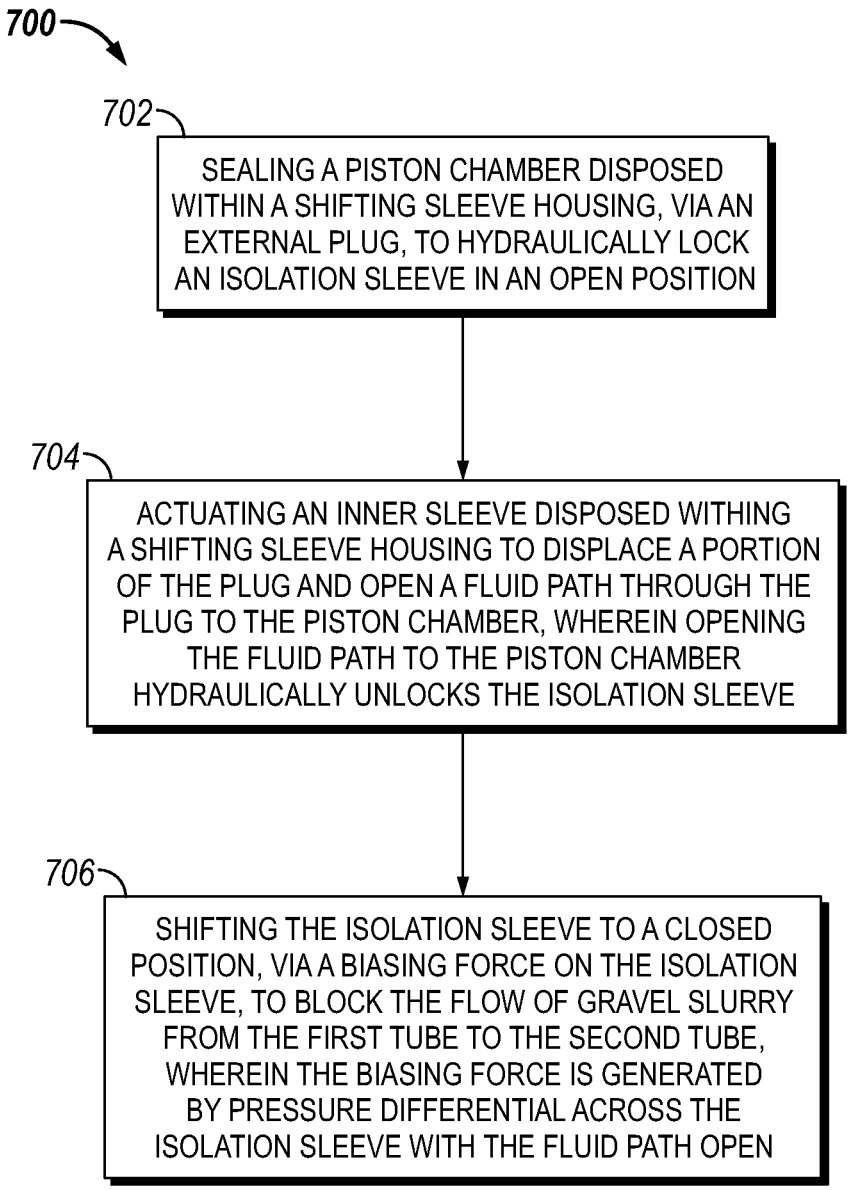
FIG. 7 illustrates a flow chart of a method for actuating the shunt tube isolation system, in accordance with some embodiments of the present disclosure.

FIG. 7 illustrates a flow chart 700 of a method for actuating the downhole shunt tube isolation system from the open position to the closed position. The method including the step 702 of sealing a piston chamber disposed within a shifting sleeve housing, via a plug, to hydraulically lock an isolation sleeve in an open position. As set forth above, a gravel slurry is configured to flow from a first tube segment to a second tube segment, via the isolation sleeve, in the open position. Further, the isolation sleeve is disposed within an isolation sleeve chamber, and wherein the piston chamber and the isolation sleeve chamber are in fluid communication. The method also includes the step 704 of actuating an inner sleeve disposed within a shifting sleeve housing to displace a portion of the plug and open the fluid path through the plug to the piston chamber. Opening the fluid path to the piston chamber hydraulically unlocks the isolation sleeve. Additionally, the method includes the step 706 of shifting the isolation sleeve to a closed position, via a biasing force on the isolation sleeve, to block flow of the gravel slurry from the first tube to the second tube. As set forth above, the biasing force is generated by a pressure differential across the isolation sleeve with the fluid path opened.

Accordingly, the present disclosure may provide shunt tube isolation systems configured to actuate from an open position to a closed position to fluidly decouple a first shunt tube segment from a second shunt tube segment, which may isolate adjacent production zones in a well. The shunt tube isolation system may include any of the various features disclosed herein, including one or more of the following statements.

Statement 1. A downhole shunt tube isolation system may comprise an isolation sleeve housing defining an isolation sleeve chamber; an isolation sleeve moveable within the isolation sleeve chamber between an open position and a closed position, the isolation sleeve having a slurry pathway extending through at least a portion of the isolation sleeve, wherein the slurry pathway fluidically couples a first slurry tube segment to a second slurry tube segment with the isolation sleeve in the open position and fluidically decouples the first slurry tube segment from the second slurry tube segment in the closed position; a fluid channel in communication with the isolation sleeve chamber, the channel initially closed to hydraulically lock the isolation sleeve in the open position; an actuation mechanism configured to open the fluid channel to hydraulically unlock the isolation sleeve; and a biasing member to bias the isolation sleeve to the closed position.

Statement 2. The system of statement 1, wherein the slurry pathway comprises a radial isolation sleeve inlet, a bore, and a radial isolation sleeve outlet, and wherein the radial isolation sleeve inlet and the radial isolation sleeve outlet pass through a radially outer surface of the isolation sleeve.

Statement 3. The system of statement 1 or statement 2, wherein the isolation sleeve inlet and the isolation sleeve outlet are angularly aligned about the circumference of the isolation sleeve.

Statement 4. The system of any preceding statement, further comprises a retention feature configured to restrain rotational and/or axial movement of the isolation sleeve with the isolation sleeve disposed in the open position.

Statement 5. The system of any preceding statement, wherein the isolation sleeve housing further defines a radial inlet, and a radial outlet, wherein the first tube segment is fluidly connected the radial inlet, and wherein the second tube segment is fluidly connected to the radial outlet.

Statement 6. The system of statement 5, further comprising an isolation inlet module and an isolation outlet module each secured the isolation sleeve housing, wherein the isolation inlet module fluidly couples the first tube segment with the radial inlet of the isolation sleeve housing, and wherein the isolation outlet module fluidly couples the second tube segment with the radial outlet of the isolation sleeve housing.

Statement 7. The system of any preceding statement, wherein the channel fluidly connects a high-pressure fluid source with a piston chamber, and wherein opening the channel permits fluid flow into the piston chamber, and wherein the piston chamber is in communication with the isolation sleeve chamber.

Statement 8. The system of any preceding statement, further comprising a plug positioned in the channel to close the channel, wherein the actuation mechanism comprises a mechanical device configured to displace a portion of the plug to open a fluid path through the plug and open the channel.

Statement 9. The system of any preceding statement, further comprising a plug positioned in the channel to close the channel, wherein actuation mechanism comprises a hydraulic device configured to displace a portion of the plug to open a fluid path through the plug and open the channel.

Statement 10. A downhole shunt tube isolation system may comprise an isolation sleeve housing defining an isolation sleeve chamber having an open axial end a sealed axial end disposed opposite the open end, a radial inlet, and a radial outlet; an isolation sleeve disposed within the isolation sleeve chamber, the isolation sleeve having a pathway extending through the isolation sleeve, wherein a gravel slurry is configured to flow through the pathway from a first tube segment, via the radial inlet, to a second tube segment, via the radial outlet, with the isolation sleeve disposed in an open position, and wherein the pathway is misaligned with respect to the radial inlet and the radial outlet to block flow of the gravel slurry from the first tube segment to the second tube segment with the isolation sleeve disposed in a closed position; a shifting sleeve housing defining a piston chamber, a central bore extending axially through the shifting sleeve housing, and a channel extending from the central bore to the piston chamber, wherein the piston chamber is in fluid communication with an open portion of the isolation chamber via the open axial end, and wherein the open portion is positioned between the open axial and the isolation sleeve; a plug disposed within the channel to seal the piston chamber from the central bore, wherein sealing the channel hydraulically locks the isolation sleeve in the open position; and an inner sleeve disposed within the central bore of the shifting sleeve, wherein the inner sleeve is configured to slide along the shifting sleeve housing to displace a portion of the plug and open a fluid path through the plug to the piston chamber, wherein opening the fluid path to the piston chamber hydraulically unlocks the isolation sleeve, and wherein a pressure differential between the open portion of the isolation chamber and a sealed portion of the isolation chamber, positioned between the isolation sleeve and the sealed axial end, drives the isolation sleeve to the closed position with the isolation sleeve hydraulically unlocked.

Statement 11. The system of statement 10, further comprising a piston disposed within the piston chamber, wherein the piston is configured to slide along the piston chamber in a direction away from the channel in response to opening the fluid path through the plug.

Statement 12. The system of statement 10 or statement 11, further comprising a hydraulic coupling configured to fluidly couple the piston chamber with the isolation sleeve chamber, wherein a hydraulic oil fills a space in the piston chamber, the hydraulic coupling, and the open portion of the isolation chamber, between the piston and the isolation sleeve, with the isolation sleeve in the open position.

Statement 13. The system of statements 10-12, further comprising a hydraulic coupling configured to fluidly couple the piston chamber with the isolation sleeve chamber, wherein the hydraulic coupling comprises passageway having a diameter between 0.5-0.01 of the diameter of the piston chamber to choke flow of the hydraulic oil from the piston chamber to the open portion of the isolation sleeve chamber.

Statement 14. The system of statements 10-13, further comprising an isolation inlet module and an isolation outlet module each secured the isolation sleeve housing, wherein the isolation inlet module fluidly couples the first tube segment with the radial inlet of the isolation sleeve housing, and wherein the isolation outlet module fluidly couples the second tube segment with the radial outlet of the isolation sleeve housing.

Statement 15. The system of statements 10-14, wherein the isolation inlet module is configured receive the gravel slurry at an axial end of the isolation inlet module and output the gravel slurry at a radial portion of the isolation inlet module.

Statement 16. The system of statements 10-15, wherein the sealed portion of the isolation sleeve chamber is filled with air comprising a pressure between 0.0-1.0 atmosphere (atm) in the open position of the isolation sleeve.

Statement 17. The system of statements 10-16, wherein the isolation sleeve comprises at least one radial seal configured to seal the sealed portion of the isolation sleeve chamber from the radial outlet, the radial inlet, and the open portion of the isolation sleeve chamber.

Statement 18. A method for actuating a downhole shunt tube isolation system, comprising: sealing a piston chamber disposed within a shifting sleeve housing, via a plug, to hydraulically lock an isolation sleeve in an open position, wherein a gravel slurry is configured to flow from a first tube segment to a second tube segment, via the isolation sleeve, in the open position, wherein the isolation sleeve is disposed within an isolation sleeve chamber, and wherein the piston chamber and the isolation sleeve chamber are in fluid communication; actuating an inner sleeve disposed within a shifting sleeve housing to displace a portion of the plug and open a fluid path through the plug to the piston chamber, wherein opening the fluid path to the piston chamber hydraulically unlocks the isolation sleeve; and shifting the isolation sleeve to a closed position, via a biasing force on the isolation sleeve, to block flow of the gravel slurry from the first tube to the second tube, wherein the biasing force is generated by a pressure differential across the isolation sleeve with the fluid path opened.

Statement 19. The method of statement 18, wherein sealing the sleeve chamber comprises inserting a plug into a slot in the shifting sleeve housing at a surface of a well completion operation to seal the piston chamber at a pressure between 0.0-1.0 atmosphere (atm).

Statement 20. The method of statement 18 or statement 19, comprising coupling the isolation sleeve to an inner surface of the isolation sleeve housing with the isolation sleeve in the closed position via a snap ring secured proximate a sealed axial end of the sealed portion of the isolation sleeve chamber.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole shunt tube isolation system, comprising:

an isolation sleeve housing defining an isolation sleeve chamber;

an isolation sleeve moveable within the isolation sleeve chamber between an open position and a closed position, the isolation sleeve having a slurry pathway extending through at least a portion of the isolation sleeve, wherein the slurry pathway fluidically couples a first slurry tube segment to a second slurry tube segment with the isolation sleeve in the open position and fluidically decouples the first slurry tube segment from the second slurry tube segment in the closed position;

a fluid channel in communication with the isolation sleeve chamber, the channel initially closed to hydraulically lock the isolation sleeve in the open position; and an actuation mechanism configured to open the fluid channel to hydraulically unlock the isolation sleeve, and wherein opening the fluid channel generates a pressure differential across the isolation sleeve that drives the isolation sleeve toward the closed position.

2. The system of claim 1, wherein the slurry pathway comprises a radial isolation sleeve inlet, a bore, and a radial isolation sleeve outlet, and wherein the radial isolation sleeve inlet and the radial isolation sleeve outlet pass through a radially outer surface of the isolation sleeve.

3. The system of claim 2, wherein the isolation sleeve inlet and the isolation sleeve outlet are angularly aligned about the circumference of the isolation sleeve.

4. The system of claim 1, further comprises a retention feature configured to restrain rotational and/or axial movement of the isolation sleeve with the isolation sleeve disposed in the open position.

5. The system of claim 1, wherein the isolation sleeve housing further defines a radial inlet, and a radial outlet, wherein the first tube segment is fluidly connected the radial inlet, and wherein the second tube segment is fluidly connected to the radial outlet.

6. The system of claim 5, further comprising an isolation inlet module and an isolation outlet module each secured the isolation sleeve housing, wherein the isolation inlet module fluidly couples the first tube segment with the radial inlet of the isolation sleeve housing, and wherein the isolation outlet module fluidly couples the second tube segment with the radial outlet of the isolation sleeve housing.

7. The system of claim 1, wherein the channel fluidly connects a high-pressure fluid source with a piston chamber, and wherein opening the channel permits fluid flow into the piston chamber, and wherein the piston chamber is in communication with the isolation sleeve chamber.

8. The system of claim 1, further comprising a plug positioned in the channel to close the channel, wherein the actuation mechanism comprises a mechanical device configured to displace a portion of the plug to open a fluid path through the plug and open the channel.

9. The system of claim 1, further comprising a plug positioned in the channel to close the channel, wherein the actuation mechanism comprises a hydraulic device configured to displace a portion of the plug to open a fluid path through the plug and open the channel.

10. The system of claim 1, further comprising a biasing member to bias the isolation sleeve toward the closed position.

11. A downhole shunt tube isolation system, comprising:

an isolation sleeve housing defining an isolation sleeve chamber having an open axial end a sealed axial end disposed opposite the open end, a radial inlet, and a radial outlet;

an isolation sleeve disposed within the isolation sleeve chamber, the isolation sleeve having a pathway extending through the isolation sleeve, wherein a gravel slurry is configured to flow through the pathway from a first tube segment, via the radial inlet, to a second tube segment, via the radial outlet, with the isolation sleeve disposed in an open position, and wherein the pathway is misaligned with respect to the radial inlet and the radial outlet to block flow of the gravel slurry from the first tube segment to the second tube segment with the isolation sleeve disposed in a closed position;

a shifting sleeve housing defining a piston chamber, a central bore extending axially through the shifting sleeve housing, and a channel extending from the central bore to the piston chamber, wherein the piston chamber is in fluid communication with an open portion of the isolation chamber via the open axial end, and wherein the open portion is positioned between the open axial and the isolation sleeve;

a plug disposed within the channel to seal the piston chamber from the central bore, wherein sealing the channel hydraulically locks the isolation sleeve in the open position; and an inner sleeve disposed within the central bore of the shifting sleeve, wherein the inner sleeve is configured to slide along the shifting sleeve housing to displace a portion of the plug and open a fluid path through the plug to the piston chamber, wherein opening the fluid path to the piston chamber hydraulically unlocks the isolation sleeve, and wherein a pressure differential between the open portion of the isolation chamber and a sealed portion of the isolation chamber, positioned between the isolation sleeve and the sealed axial end, drives the isolation sleeve to the closed position with the isolation sleeve hydraulically unlocked.

12. The system of claim 11, further comprising a piston disposed within the piston chamber, wherein the piston is configured to slide along the piston chamber in a direction away from the channel in response to opening the fluid path through the plug.

13. The system of claim 12, further comprising a hydraulic coupling configured to fluidly couple the piston chamber with the isolation sleeve chamber, wherein a hydraulic oil fills a space in the piston chamber, the hydraulic coupling, and the open portion of the isolation chamber, between the piston and the isolation sleeve, with the isolation sleeve in the open position.

14. The system of claim 11, further comprising a hydraulic coupling configured to fluidly couple the piston chamber with the isolation sleeve chamber, wherein the hydraulic coupling comprises passageway having a diameter between 0.5-0.01 of the diameter of the piston chamber to choke flow of the hydraulic oil from the piston chamber to the open portion of the isolation sleeve chamber.

15. The system of claim 11, further comprising an isolation inlet module and an isolation outlet module each secured the isolation sleeve housing, wherein the isolation inlet module fluidly couples the first tube segment with the radial inlet of the isolation sleeve housing, and wherein the isolation outlet module fluidly couples the second tube segment with the radial outlet of the isolation sleeve housing.

16. The system of claim 15, wherein the isolation inlet module is configured receive the gravel slurry at an axial end of the isolation inlet module and output the gravel slurry at a radial portion of the isolation inlet module.

17. The system of claim 11, wherein the sealed portion of the isolation sleeve chamber is filled with air comprising a pressure between 0.0-1.0 atmosphere (atm) in the open position of the isolation sleeve.

18. The system of claim 11, wherein the isolation sleeve comprises at least one radial seal configured to seal the sealed portion of the isolation sleeve chamber from the radial outlet, the radial inlet, and the open portion of the isolation sleeve chamber.

19. A method for actuating a downhole shunt tube isolation system, comprising:

sealing a piston chamber disposed within a shifting sleeve housing, via a plug, to hydraulically lock an isolation sleeve in an open position, wherein a gravel slurry is configured to flow from a first tube segment to a second tube segment, via the isolation sleeve, in the open position, wherein the isolation sleeve is disposed within an isolation sleeve chamber, and wherein the piston chamber and the isolation sleeve chamber are in fluid communication;

actuating an inner sleeve disposed within a shifting sleeve housing to displace a portion of the plug and open a fluid path through the plug to the piston chamber, wherein opening the fluid path to the piston chamber hydraulically unlocks the isolation sleeve; and shifting the isolation sleeve to a closed position, via a biasing force on the isolation sleeve, to block flow of the gravel slurry from the first tube segment to the second tube segment, wherein the biasing force is generated by a pressure differential across the isolation sleeve with the fluid path opened.

20. The method of claim 19, wherein sealing the sleeve chamber comprises inserting a plug into a slot in the shifting sleeve housing at a surface of a well completion operation to seal the piston chamber at a pressure between 0.0-1.0 atmosphere (atm).

21. The method of claim 19, comprising coupling the isolation sleeve to an inner surface of the isolation sleeve housing with the isolation sleeve in the closed position via a snap ring secured proximate a sealed axial end of the sealed portion of the isolation sleeve chamber.

* * * * *